US007168505B2

(12) United States Patent
Yamada

(10) Patent No.: US 7,168,505 B2
(45) Date of Patent: Jan. 30, 2007

(54) ROTARY TOOL

(75) Inventor: Yukihiko Yamada, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 11/289,432

(22) Filed: Nov. 30, 2005

(65) Prior Publication Data

US 2006/0118318 A1 Jun. 8, 2006

(30) Foreign Application Priority Data

Dec. 2, 2004 (JP) ..... 2004-349992

(51) Int. Cl.
*B25B 21/00* (2006.01)

(52) U.S. Cl. ..... 173/178; 173/48; 192/150

(58) Field of Classification Search ..... 173/176, 173/178, 216, 179, 93, 109, 48; 192/150, 192/34, 54.5; 81/467, 473
See application file for complete search history.

(56) References Cited

U.S. PATENT DOCUMENTS

| | | | | |
|---|---|---|---|---|
| 5,209,308 | A | 5/1993 | Sasaki et al. | |
| 5,343,961 | A * | 9/1994 | Ichikawa | 173/48 |
| 5,372,206 | A * | 12/1994 | Sasaki et al. | 173/178 |
| 5,458,206 | A * | 10/1995 | Bourner et al. | 173/178 |
| 5,538,089 | A * | 7/1996 | Sanford | 173/2 |
| 5,568,849 | A * | 10/1996 | Sasaki et al. | 192/34 |
| 5,947,210 | A | 9/1999 | Sasaki et al. | |
| 6,173,792 | B1 * | 1/2001 | Hald | 173/178 |
| 6,536,537 | B1 * | 3/2003 | Sasaki et al. | 173/178 |
| 7,100,482 | B2 * | 9/2006 | Neumaier | 81/429 |

FOREIGN PATENT DOCUMENTS

| | | | |
|---|---|---|---|
| DE | 3818924 A1 | 6/1989 | |
| EP | 1 033 204 A2 | 9/2000 | |
| JP | A 2000-246657 | 9/2000 | |

* cited by examiner

*Primary Examiner*—Scott A. Smith
(74) *Attorney, Agent, or Firm*—Oliff & Berridge, PLC

(57) ABSTRACT

It is an object of the invention to provide an effective technique for reducing wear of sliding contact areas in an engagement clutch of a rotary tool. According to the invention, a representative rotary tool may comprise a motor, a tool bit, a driving-side clutch element, a driven-side clutch element, a biasing spring, a rotation preventing member and an enclosure. The biasing spring biases the driven-side clutch element toward the power transmission prevented position. The biasing spring is disposed in a compressed state on the outer peripheral side of the driving-side clutch element and the driven-side clutch element and extends between the driving-side clutch element and the driven-side clutch element. At least part of the biasing spring is enclosed by the enclosure. Lubricant deposited on the inner wall surface of the enclosure is supplied to either a sliding contact area between the biasing spring and the driving-side clutch element or a sliding contact area between the biasing spring and the driven-side clutch element by rotation of the biasing spring. According to the invention, lubricant applied to the engagement areas flies outward by rotation of the driving-side clutch element and deposited on the inner wall surface of the enclosure. Then, the deposited lubricant is actively supplied to the sliding contact areas between the biasing spring and the driving-side clutch element or the driven-side clutch element by utilizing rotation of the biasing spring. Thus, the effect of lubrication of the sliding contact areas can be enhanced.

5 Claims, 2 Drawing Sheets

ROTARY TOOL

BACKGROUND OF THE INVENTION

1. Field of the Invention

The invention relates to a rotary tool having an engagement clutch torque of a motor to a tool bit and stops the torque transmission.

2. Description of the Related Art

As an example of a rotary tool having an engagement clutch, a known electric screwdriver for use in screw-tightening operation is disclosed in Japanese unexamined laid-open patent publication No. 2000-246657. In the known screwdriver, a driving-side clutch element driven by a motor is disposed opposite to a driven-side clutch element that rotates together with a spindle. In screw-tightening operation, when a driver bit is pressed against a workpiece, the driven-side clutch element is caused to move (retract) toward the driving-side clutch element together with the spindle so that the clutch teeth of the clutch elements engage with each other. As a result, the driver bit supported by the end of the spindle is drivingly rotated.

The known screwdriver is of the type in which the spindle rotates at high speed (for example, 6000 rpm). Therefore, a synchronizing mechanism is provided for rotating the driven-side clutch element in synchronizing with the driving-side clutch element. The synchronizing mechanism includes a biasing spring in the form of a compression coil spring that is disposed in a compressed state between the driving-side clutch element and the driven-side clutch element. The ends of the compression coil spring are slidably engaged with the driving-side clutch element and the driven-side clutch element via washers. In the state in which a screw-tightening operation is not being performed, the driven-side clutch element is pressed against a rubber stopper ring and held in a rotation prevented state. However, when the driver bit is pressed against the workpiece in order to start a screw-tightening operation, or when the driven-side clutch element moves toward the driving-side clutch element together with the spindle, the driven-side clutch element is disengaged from the stopper ring and thus released from the rotation prevented state. As a result, the driven-side clutch element synchronously rotates following rotation of the driving-side clutch element via the biasing spring. As a result, the clutch teeth of the driving-side clutch element and the driven-side clutch element can be smoothly engaged with each other.

In an engagement clutch having a synchronizing mechanism as described above, lubricant is applied to the sliding contact areas between the compression coil spring and the both clutch elements in order to reduce wear of the sliding contact areas. However, in the known construction, the compression coil spring is disposed on the inner peripheral side of the clutch elements and the grease flies outward by centrifugal force that is caused by high-speed rotation of the engagement clutch. As a result, a shortage of lubricant may possibly be caused on the sliding contact areas. Therefore, further improvement is required in the known engagement clutch with respect to the lubrication of the sliding areas.

SUMMARY OF THE INVENTION

Accordingly, it is an object of the invention to provide an effective technique for reducing wear of sliding contact areas in an engagement clutch of a rotary tool.

According to the invention, a representative rotary tool may comprise a motor, a tool bit, a driving-side clutch element, a driven-side clutch element, a biasing spring, a rotary preventing member and an enclosure. The driving-side clutch element is driven by the motor. The driven-side clutch element is disposed opposite to the driving-side clutch element and can move between a power transmission allowed position and a power transmission prevented position. In the power transmission allowed position, the driven-side clutch element is allowed to transmit rotating torque to the tool bit by moving toward the driving-side clutch element into engagement. In the power transmitted prevented position, it is prevented from transmitting the rotating torque to the tool by moving away from the driving-side clutch element into disengagement.

The biasing spring is disposed in a compression state on the outer peripheral side of the driving-side clutch element and the driven-side clutch element and extends between the driving-side clutch element and the driven-side clutch element. The biasing spring biases the driven-side clutch element toward the power transmission prevented position.

The rotation preventing member engages with the driven-side clutch element in the power transmission prevented position, thereby preventing rotation of the driven-side clutch element. During driving rotation of the driving-side clutch element, in the power transmission prevented position, the driven-side clutch element is engaged with the rotation preventing member by the biasing force of the biasing spring so that is prevented from the rotation. When the driven-side clutch element moves from the power transmission prevented position to the power transmission allowed position, it is disengaged from the rotation preventing member and thus released from the rotation prevention of the rotation preventing member. As a result, the driven-side clutch element rotates following rotation of the driven-side clutch element via the biasing spring and thereafter engages with the driving-side clutch element. The "rotary tool" in the invention is typically applied to an electric screwdriver in which a tool bit performs a screw-tightening operation by rotating in the circumferential direction, but it can be widely applied to any rotary tool having an engagement clutch.

With a rotary tool having the above-mentioned construction, when the driven-side clutch element moves from the power transmission prevented position to the power transmission allowed position, the rotational speed of the driving-side clutch element can be synchronized with or approximated to the rotational speed of the driven-side clutch element via the biasing spring. As a result, engagement between the driving-side clutch element and the driven-side clutch element can be smoothly performed. The "biasing spring" in the invention is thus provided as a means for synchronizing or approximation the rotational speed of the driving-side clutch element to that of the driven-side clutch element.

At least part of the biasing spring in its circumferential and axial directions in the outer peripheral region of the biasing spring is enclosed by the enclosure. Further, lubrication deposited on the inner wall surface of the enclosure is supplied to either a sliding contact area between the biasing spring and the driving-side clutch element or a sliding contact area between the biasing spring and the driven-side clutch element by rotation of the biasing spring.

Typically, a compression coil spring may preferably be used as the "biasing spring" according to the invention. Further, the manner in which "at least part of the biasing spring is enclosed by the enclosure" may include the manner in which the entirety of the biasing spring in its circumferential and axial directions is completely enclosed, the manner in which part of the biasing spring in its axial direction is enclosed and the manner in which part of the biasing spring in its circumferential and axial directions is enclosed.

Further, the manner in which "lubrication is supplied by rotation of the biasing spring" includes the manner in which the lubrication is transferred to the sliding contact areas by utilizing the rotation of the biasing spring. In this case, the direction of transfer is determined by the relationship between the direction of rotation of the driving-side clutch element and the direction of winding of the biasing spring. For example, of the biasing spring is wound in the direction opposite to the direction of the rotation of the driving-side clutch element, the lubricant can be transferred to the sliding contact area between the biasing spring and the driven-side clutch element. Therefore, in enclosing at least part of the biasing spring in its outer peripheral region by the enclosure, the area to be enclosed by the enclosure and the clearance between the outer peripheral surface of the biasing spring and the inner wall surface of the enclosure are determined such that the affectiveness for the enclosure in guarding against fly-off of the lubricant and the effectiveness for the biasing spring in supplying the lubricant can be optimized.

According to the invention, the biasing spring is disposed on the outer peripheral side of the driving-side clutch element and the driven-side clutch element to extend between the driving-side clutch element and the driven-side clutch element. Further, at least part of the biasing spring in its outer peripheral region is enclosed by the enclosure. With this construction, lubricant such as grease applied to the engagement areas between the driving-side clutch element and the driven-side clutch element may be caused to fly outward by rotation of the driving-side clutch element and deposited on the inner wall surface of the enclosure. Then, the deposited lubricant on the inner wall surface can be actively supplied to the sliding contact areas between the biasing spring and the driving-side clutch element or the driven-side clutch element by utilizing rotation of the biasing spring. Thus, the effect of lubrication of the sliding contact areas can be enhanced, so that the wear can be reduced.

Other objects, features and advantages of the invention will be readily understood after reading the following detailed description together with the accompanying drawings and the claims.

BRIEF DESCRIPTION OF THE DRAWINGS

FIG. 2 shows a driving mechanism of a driver bit.

DETAILED DESCRIPTION OF THE INVENTION

Each of the additional features and method steps disclosed above and below may be utilized separately or in conjunction with other features and method steps to provide and manufacture improved rotary tools and method for using such rotary tools and devices utilized therein. Representative examples of the invention, which examples utilize many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
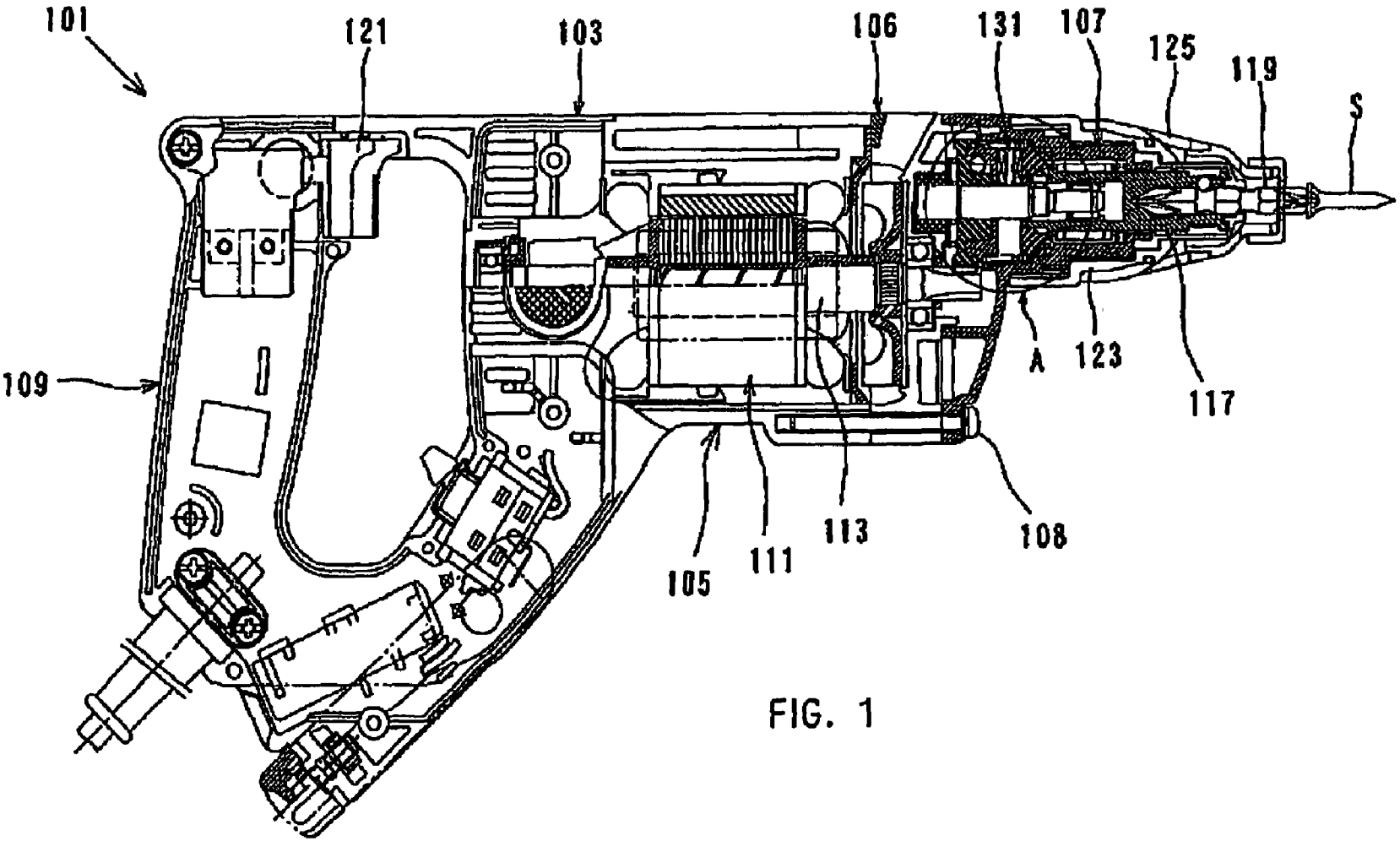
FIG. 1 is a side view, partly in section, schematically showing an entire screwdriver according to a representative embodiment of the invention.

An embodiment of the invention will now be described with reference to FIGS. 1 to 3. FIG. 1 shows an entire view of an electric screwdriver 101 as a representative example of the rotary tool according to the invention. The representative screwdriver 101 includes a body 103, a driver bit 119 and a handgrip 109. The driver 119 is detachably coupled to the tip end region of the body 103 via a spindle 117. The handgrip 109 is connected to the body 103 on the side opposite to the driver bit 119. The driver bit 119 is a feature that corresponds to the "tool bit" according to the invention. For the sake of convenience of explanation, the side of the driver bit 119 is taken as the front side and the side of the handgrip 109 as the rear side in the following description.

The body 103 includes a motor housing 105 and a clutch housing 107. The motor housing 103 houses a driving motor 111. The clutch housing 107 houses an engagement clutch 131 that transmits the rotating output of the motor 111 to the spindle 117 or stops the transmission of the rotating output. The driving motor 111 is driving by depressing a trigger 121 on the handgrip 109 and stopped by releasing the trigger 121.

Figure 2:
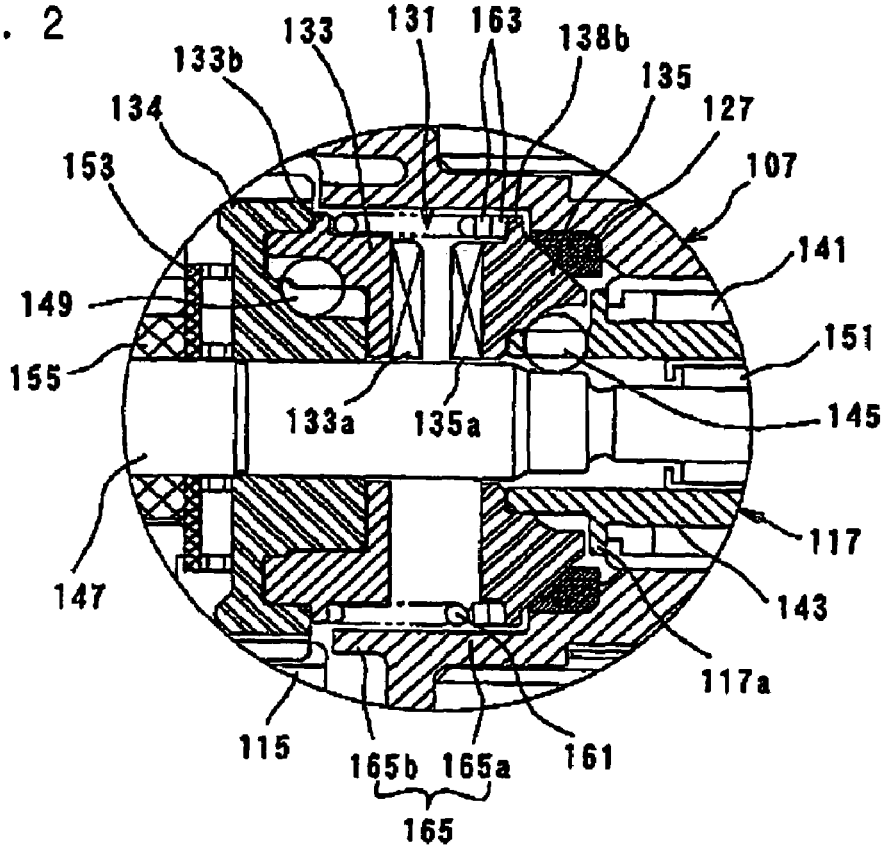
FIG. 2 is an enlarged view of circled part "A" in FIG. 1.
Figure 3:
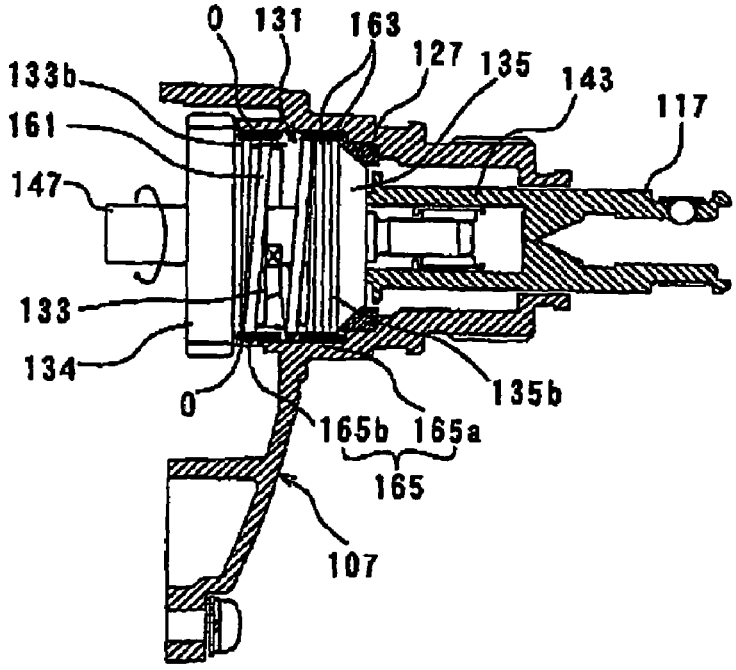
FIG. 3 is a view illustrating the flow of lubricant in an engagement clutch.

FIG. 2 shows a detailed construction of the engagement clutch 131. The engagement clutch 131 includes a driving-side clutch member 133 that is driven by the motor 111 and a spindle-side clutch member 135 that is mounted on the spindle 117. The clutch members 133 and 135 are coaxially disposed opposite to each other and have clutch teeth 133*a* and 135*a* that are formed on the opposed sides and can engage with each other. The driving-side clutch member 133 and the spindle-side clutch member 135 are features that respectively correspond to the "driving-side clutch element" and the "driven-side clutch element" according to the invention.

When the driver bit 119 supported by the spindle 117 is pressed against a workpiece (not shown) via screw "S" in order to tighten the screw "S" in the workpiece "W", the clutch teeth 135*a* of the spindle-side clutch member 135 engage with the clutch teeth 133*a* of the driving-side clutch member 133. Further, when such pressing of the driver bit 119 is stopped, the above-mentioned engagement is released by the biasing force of an elastic member in the form of a compression coil spring 161. Thus, the spindle-side clutch member 135 moves between an engagement position in which it engages with the driving-side clutch member 133 by moving toward (retracting away from) the driving-side clutch member 133 together with the spindle 117 and a disengagement position in which it disengages from the driving-side clutch member 133 by moving away from (advancing toward) the driving-side clutch member 133. The engagement position and the disengagement position correspond to the "power transmission allowed position" and the "power transmission prevented position", respectively, in the invention. The compression coil spring 161 is a feature that corresponds to the "biasing spring" in the invention. Further, in the following description, the clutch teeth 133*a* of the driving-side clutch member 133 and the clutch teeth 135*a* of the spindle-side clutch member 135 will be referred to as driving-side clutch teeth 133*a* and driven-side clutch teeth 135*a*, respectively.

Construction of each component of the engagement clutch will now be explained in detail. The spindle 117 is rotatably and axially moveably supported by the clutch housing 107 via a bearing 141. The forward movement of the spindle 117 is restricted by contact between a flange 117*a* of the spindle 117 and an axial end surface of the bearing 141. The spindle-side clutch member 135 is fitted on an axially rear end portion of the spindle 117. The spindle-side clutch member 135 can rotate together with the spindle 117 via a plurality of steel balls 145.

The driving-side clutch member 133 is loosely fitted onto a support shaft 147 and mounted on a driving gear 134 that is press-fitted onto the support shaft 147 such that the driving-side clutch member 133 can rotate together with the driving gear 134 via a plurality of steel balls 149. The driving gear 134 normally engages with a pinion gear 115 on an output shaft 113 of the motor 111. One end of the support shaft 147 is inserted into the bore of a cylindrical portion 143 of the spindle 117 and is supported by the cylindrical portion 143 via a bearing 151, such that the support shaft 147 can rotate and move in the axial direction with respect to the spindle 117. Further, the other end of the support shaft 143 is supported by a fan housing 106 via a support ring 155, such that the support shaft 143 can rotate. The fan housing 106 is disposed between the motor housing 105 and the clutch housing 107 and joined there by means of a plurality of clamping bolt 108. A thrust bearing 153 is disposed on the rear side of the driving-side clutch member 133. The thrust bearing 153 receives a thrust load that is applied to the driving-side clutch member 133 during operation of tightening the screw S.

The compression coil spring 161 is disposed in a compressed state in the outer peripheral region of the driving-side clutch member 133 and the spindle-side clutch member 135 between the opposed surfaces of the driving-side clutch member 133 and the spindle-side clutch member 135, i.e. on the outer peripheral side of the driving-side clutch teeth 133*a* and the driven-side clutch teeth 135*a*. The spindle-side clutch member 135 is normally biased forward away from the driving-side clutch member 133 by the compression coil spring 161. By this biasing force, not only the driven-side clutch teeth 135*a* are disengaged from the driving-side clutch teeth 133*a*, but the spindle-side clutch member 135 is pressed against a stopper ring 127 so as to be prevented from rotation. The stopper ring 127 is made of rubber and mounted on the clutch housing 107. The stopper ring 127 is a feature that corresponds to the "rotation preventing member" in the invention. Further, the contact surfaces of the stopper ring 127 and the clutch housing 107 have a complementary projection or depression such that the stopper ring 127 is engaged with the clutch housing 107 and prevented from rotating with respect to the clutch housing 107.

A flange-shaped spring receiving portion 133*b* for receiving one end of the compression coil spring 161 is formed on the outer peripheral surface of the driving-side clutch member 133. Correspondingly, a flange-shaped spring receiving portion 135*b* for receiving the other end of the compression coil spring 161 is formed on the outer peripheral surface of the spindle-side clutch member 135. The one end of the compression coil spring 161 is fixedly mounted on the spring receiving portion 133*b* of the driving-side clutch member 133. The other end of the compression coil spring 161 is mounted on the spring receiving portion 135*b* of the spindle-side clutch member 135 via a plurality of (two) washers 163 such that it can rotate with respect to the spring receiving portion 135*b*. In other words, an area of sliding contact with the compression coil spring 161 via the washers 163 is provided only on the side of the spindle-side clutch member 135. Further, in this embodiment, the compression coil spring 161 is wound counterclockwise, i.e., in the direction opposite to the direction of rotation of the engagement clutch 131.

The clutch housing 107 has a cylindrical enclosure 165 that enclosed the compression coil spring 161. The cylindrical enclosure 165 parallel to the compression coil spring 161 between the spindle-side clutch member 135 and the driving-side clutch member 133 in such a manner as to enclose the outer peripheral surfaces of the clutch members. The enclosure 165 includes an enclosing portion 165*a* and an extending portion 165*b*. The enclosing portion 165*a* is configured to enclose the outer peripheral surface of the spindle-side clutch member 135, and the extending portion 165*b* extends rearward from the enclosing portion 165*a* and encloses the outer peripheral surface of the driving-side clutch member 133. The enclosure 165 is configured and arranged so as to keep a clearance large enough to avoid interference between its inner wall surface and the outer peripheral surface of the compression coil spring 161. The clutch housing 107 is filled with lubricant (grease) to lubricate the area of the engagement of the engagement clutch 131, the area of engagement between the driving gear 134 and the pinion gear 115, the area of sliding contact between the members that rotate with respect to each other.

The driver bit 119 is detachably coupled to the tip end portion (front end portion) of the spindle 117. Further, an adjuster sleeve 123 is fitted on the front end portion of the clutch housing 107 and can adjust its axial position. A stopper sleeve 125 is detachably mounted on the front end of the adjuster sleeve 123. The amount of protrusion of the driver bit 119 from the tip end of the stopper sleeve 125 is adjusted by adjusting the axial position sleeve 123. In this manner, the tightening depth of the screw S can be adjusted.

Operation of the electric screwdriver 101 having the above-mentioned construction will now be explained. FIGS. 1 and 2 show the state in which a crew-tightening operation is still not being performed. In this state, the spindle-side clutch member 135 is held disengaged from the driving-side clutch member 133 and pressed against the stopper ring 127 by the biasing force of the compression coil spring 161. Thus, the driven-side clutch teeth 135*a* are not engaged with the driving-side clutch teeth 133*a*, so that the engagement clutch 131 is in the disengaged state. In this state, when the trigger 121 is depressed to drive the motor 111, the driving-side clutch member 133 and the compression coil spring 161 that is fixed to the driving-side clutch member 133 are caused to rotate. However, the spindle-side clutch member 135 is held in a rotation prevented state by the stopper ring 127 because the friction between the engagement surfaces (contact surfaces) of the spindle-side clutch member 135 and the stopper ring 127 is greater than the friction between the sliding contact areas of the spindle-side clutch member 135 and the compression coil spring 161. Thus, the compression coil spring 161 rotates with respect to the spindle-side clutch member 135 via the washers 163, and the spindle 117 is held stationary.

In this state, when the screw S on the driver bit 119 is pressed against the workpiece W by moving the screwdriver 101 forward (toward the workpiece) in order to perform a screw-tightening operation, the body 103 moves, but the driver bit 119 and the spindle 117 do not move. Therefore, the driver bit 119 and the spindle 117 retract (leftward as viewed in the drawing) with respect to the body 103 while compressing the compression coil spring 161. At this time, the spindle-side clutch member 135 is caused to retract toward the driving-side clutch member 133 and thus disengage from the stopper ring 127. As a result, the spindle-side clutch member 135 which has thus been released from the rotation prevention of the stopper ring 127 rotates following rotation of the compression coil spring 161, and the rotation of the spindle-side clutch member 135 synchronizes with rotation of the driving-side clutch member 133. Thereafter, the driven-side clutch teeth 135*a* engage with the driving-side clutch teeth 133*a*. This, such engagement of the clutch teeth is smoothly performed. As mentioned above, the compression coil spring 161 serves as a synchronizing member to synchronize the rotational speed of the driving-side clutch member 133 and the spindle-side clutch member 135. The compression coil spring 161 is particularly effective for the engagement clutch 131 of the electric screwdriver 101 of the type in which the spindle 117 rotates at a high speed (for example, 6000 rpm).

The lubricant is caused to fly off so as to be sputtered in the radial direction by rotation of the driving-side clutch member 133 and the compression coil spring 161 or the rotation of the spindle-side clutch member 135 which is caused by engagement with the driving-side clutch member 133. As shown in FIG. 3, the lubricant is then deposited on the inner wall surface of the enclosure 165. The deposited lubricant "O" on the inner wall surface is actively transferred forward toward the washers 163 by utilizing the rotation of the compression coil spring 161. With the transferred lubricant, the sliding contact areas with respect to the washers 162, i.e. the areas between the two washers 163, between the compression coil spring 161 and the washer 163 and between the spindle-side clutch member 135 and the washer 163, can be lubricated. In this case, the clearance between the inner wall surface of the enclosure 165 and the outer peripheral surface of the compression coil spring 161 is provided such that the compression coil spring 161 can transfer the deposited lubricant "O" without interfering with the inner wall surface of the enclosure 165.

According to the representative embodiment, the compression coil spring 161 is disposed around the engagement clutch 131 (on the outer peripheral side), the cylindrical enclosure 165 encloses the entire outer peripheral surface of the compression coil spring 161, and the lubricant "O" that has been caused to fly off by rotation of the engagement clutch 131 and deposited on the inner wall surface of the enclosure 165 is actively transferred toward the washers 163 by utilizing rotation of the compression coil spring 161 so that the washers 163 are lubricated. In a known art in which the compression coil spring 161 is disposed on the inner peripheral side of the engagement clutch 131, lubricant flies off by centrifugal force caused by rotation of the engagement clutch 131. As a result, shortage of lubricant may be caused in the sliding contact areas. On the other hand, according to the representative embodiment, such lubricant shortage problem can be eliminated so that the washers 163 can be effectively lubricated. Thus, wear of the washers 163 can be reduced.

Further, in this embodiment, one end of the compression coil spring 161 is fixed to the driving-side clutch member 133. In other words, a sliding contact area with respect to the compression coil spring 161 is provided only on the side of the spindle-side clutch member 135. Thus, the sliding contact area of the compression coil spring 161 is specifically provided on the spindle-side clutch member 135, and the lubricant "O" is actively supplied to lubricate the specific sliding contact area. As a result, efficient lubrication can be improved. Further, two (a plurality of) washers 163 are disposed in the sliding contact area. Thus, the sliding contact surface is scattered among a plurality of areas, such as the areas between the two washers 163, between the compression coil spring 161 and the washer 163 and between the spindle-side clutch member 135 and the washer 163. As a result, the sliding speed per unit sliding area can be reduced, so that the wear can be effectively reduced.

Further, the washers 163 may preferably comprise high-carbon chromium bearing steel (SUJ). Such washers 163 do not easily seize even if oil film is gone on the sliding surface, so that SUJ is considered to be effective in terms of resistance to wear.

Changes or modifications may be made to this embodiment. For example, it may be constructed such that the compression coil spring 161 can rotate with respect to both the driving-side clutch member 133 and the spindle-side clutch member 135. Further, the active supply of the lubricant by the compression coil spring 161 may be provided toward the driving-side clutch member 133, instead of the spindle-side clutch member 135. Further, the driving gear 134 and the driving-side clutch member 133 may be formed in one piece or fixedly joined to each other. The spindle 117 and the spindle-side clutch member 135 may also be formed in one piece or fixedly joined to each other. Further, the enclosure 165 mat enclose part of the outer peripheral region of the compression coil spring 161.

Further, according to the embodiment, the electric screwdriver 101 for tightening the screw S has been described as a representative example of the rotary tool in the invention. However, the invention is not limited to the screwdriver 101, but may be widely applied to any rotary tool in which the torque of the driving motor 111 is transmitted to the tool bit via the engagement clutch 131.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

DESCRIPTION OF NUMERALS

101 electric screwdriver (rotary tool)
103 body
105 motor housing
106 fan housing
107 clutch housing
108 claping bolts
109 handgrip
111 driving motor (motor)
113 output shaft
115 pinion gear
117 spindle
117*a* flange
119 driver bit (tool bit)
121 trigger
123 adjuster sleeve
125 stopper sleeve
127 stopper ring
131 engagement clutch

133 driving-side clutch member (driving-side clutch element)
133*a* driving-side clutch teeth
133*b* spring receiving portion
134 driving gear
135 spindle-side clutch member (driven-side clutch element)
135*a* driven-side clutch teeth
135*b* spring receiving portion
141 bearing
143 cylindrical portion
145 steel ball
147 support shaft
149 steel ball
151 bearing
153 thrust bearing
155 support ring
161 compression spring (biasing spring)
163 washer
165 enclosure
165*a* enclosing portion

What I claim is:

1. A rotary tool comprising:

a motor, a tool bit driven by the motor, a driving-side clutch element rotated by the motor, a driven-side clutch element disposed opposite to the driving-side clutch element and can move between a power transmission allowed position in which the driven-side clutch element is allowed to transmit rotating torque to the tool bit by moving toward the driving-side clutch element into engagement and a power transmission prevented position in which transmitting of the rotating torque to the tool bit is prevented by moving away from the driving-side clutch element into disengagement, a biasing spring disposed in a compressed state on the outer peripheral side of the driving-side clutch element and the driven-side clutch element to extend between the driving-side clutch element and the driven-side clutch element, wherein the biasing spring biases the driven-side clutch element toward the power transmission prevented position, a rotation preventing member that engages with the driven-side clutch element in the power transmission prevented position to prevent rotation of the driven-side clutch element, wherein during driving rotation of the driving-side clutch element, in the power transmission prevented position, the driven-side clutch element is engaged with the rotation preventing member by the biasing force of the biasing spring so as to be prevented from rotation, while, when the driven-side clutch element moves from the power transmission prevented position to the power transmission allowed position, the driven-side clutch element is disengaged from the rotation preventing member and released from the rotation prevention of the rotation preventing member, whereby the driven-side clutch element rotates following rotation of the driving-side clutch element via the biasing spring and engages with the driving-side clutch element, an enclosure that encloses the biasing spring, wherein at least part of the biasing spring in its circumferential and axial directions in the outer peripheral region of the biasing spring is enclosed by the enclosure and a sliding contact area between the biasing spring and the driving-side clutch element or between the biasing spring and the driven-side clutch element, wherein lubricant deposited on the inner wall surface of the enclosure is supplied to the sliding contact area by rotation of the biasing spring.

2. The rotary tool as defined in claim 1, wherein the biasing spring is wound in the direction opposite to the direction of rotation of the driving-side clutch element, the lubricant is transferred to the sliding contact area between the biasing spring and the driven-side clutch element.

3. The rotary tool as defined in claim 1, wherein one end of the biasing spring is fixed to one of the driving-side clutch element and the driven-side clutch element, and the other end is engaged with the other of the driving-side clutch element and the driven-side clutch element via a plurality of washers such that the spring can slide in the circumferential direction.

4. The rotary tool as defined in claim 3, wherein one end of the biasing spring is fixed to the driving-side clutch element, and the other end is engaged with the driven-side clutch element via a plurality of washers so as to be slidable in the circumferential direction.

5. The rotary tool as defined in claim 1, wherein the rotary tool is defined by a screw driver.

* * * * *